United States Patent [19]

Flick et al.

[11] Patent Number: 4,528,531

[45] Date of Patent: Jul. 9, 1985

[54] MOLDED CASE CIRCUIT BREAKER WITH IMPROVED OPERATING MECHANISM

[75] Inventors: Robert H. Flick, Brighton Township, Beaver County; Walter K. Huffman, Towamencin Township, Montgomery County, both of Pa.

[73] Assignee: Westinghouse Electric Corp., Pittsburgh, Pa.

[21] Appl. No.: 562,643

[22] Filed: Dec. 19, 1983

[51] Int. Cl.[3] ..... H01H 3/12

[52] U.S. Cl. ..... 335/23; 335/35; 335/191

[58] Field of Search ..... 335/16, 21, 22, 188, 335/191, 23, 35; 200/153 G

[56] References Cited

U.S. PATENT DOCUMENTS 3,305,806 2/1967 Norden ..... 335/191

3,492,614 1/1970 De Angelo et al. ..... 335/21

*Primary Examiner*—E. A. Goldberg

*Assistant Examiner*—George Andrews

*Attorney, Agent, or Firm*—Michael S. Yatsko

[57] ABSTRACT

A molded case circuit breaker includes a highly integrated operating mechanism having an over-center toggle mechanism for opening and closing a pair of electrical contacts and a trip mechanism for responding to overload and short circuit or fault current conditions to separate the pair of electrical contacts. A generally flat, intermediate latch plate includes an upper latch surface for latching with a movable cradle of the over-center toggle mechanism and a lower latch surface for latching with a trip bar of the trip mechanism and a pair of outwardly projecting pivot arms disposed between the upper and lower latch surfaces. The over-center toggle mechanism includes a pair of upper toggle links and a pair of lower toggle links interconnected by a toggle spring pin. To increase the speed of separation of the first and second electrical contacts during a trip operation, the cradle is physically configured to engage and upwardly propel the toggle spring pin and, also, the upper toggle links have projections for physically contacting a rigid stop.

16 Claims, 26 Drawing Figures

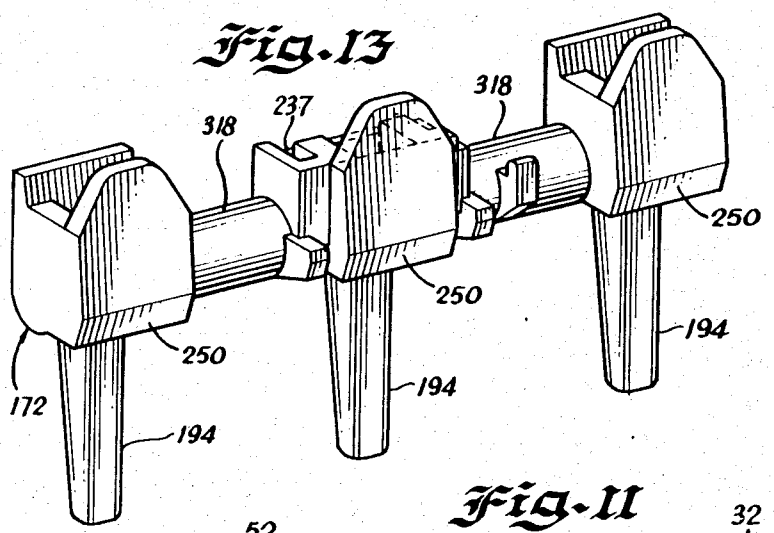
Fig. 13
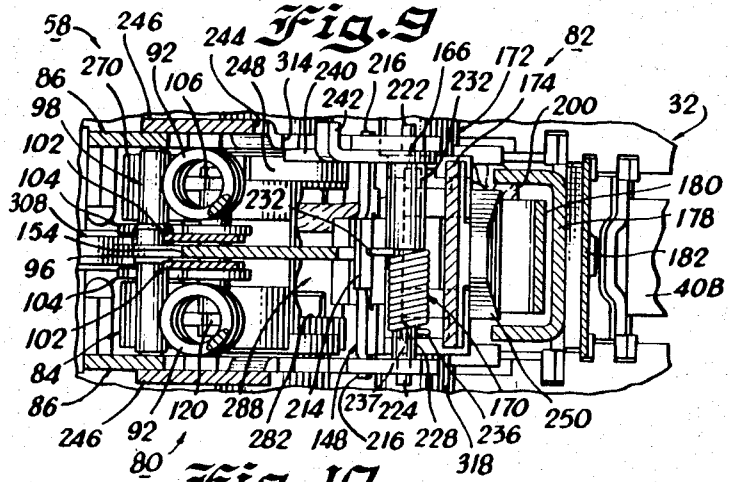
Fig. 9
Fig. 10
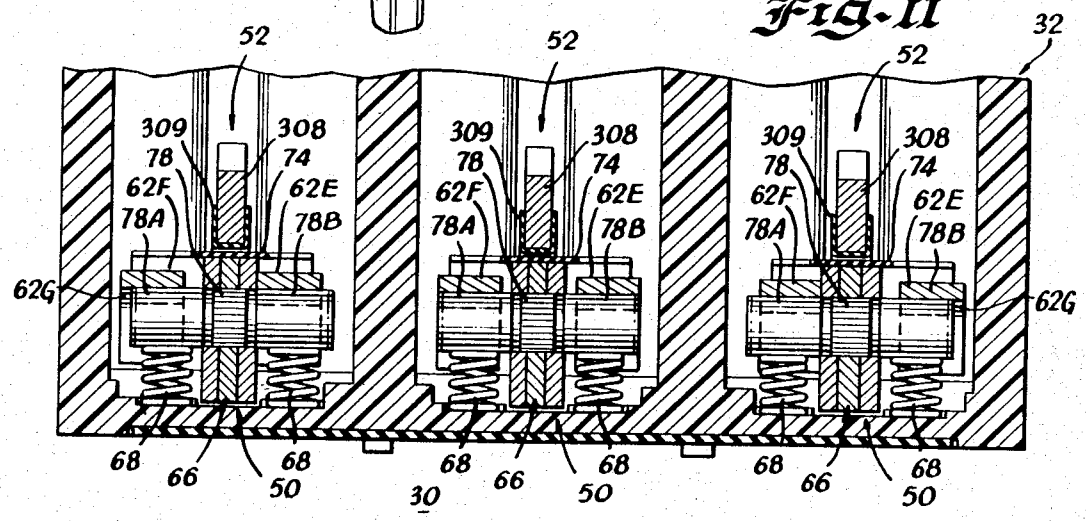
Fig. 11

30
42
32
58
270
200
436
434
412
422
416
418
414
432
84
110
156
420
424
56
322
54
410
50
34
66
426
428
17

30
42
58
270
452
200
454
458
464
462
84
110
156
332
32
456
466
460
56
66
50
34
54
450
20

MOLDED CASE CIRCUIT BREAKER WITH IMPROVED OPERATING MECHANISM

CROSS REFERENCE TO RELATED APPLICATIONS

The invention disclosed herein relates to molded case circuit breakers. The inventions disclosed in the following four commonly assigned U.S. patent applications also relate to molded case circuit breakers: U.S. patent application Ser. Nos. 440,680; 440,681; 440,682; and 440,683, all of which were filed on Nov. 10, 1982.

The following five commonly assigned U.S. patent applications were filed in the U.S. Patent and Trademark Office on Dec. 19, 1983 the same day as this patent application and also relate to molded case circuit breakers: Ser. No. 562,647 filed by Alfred E. Maier and entitled Molded Case Circuit Breaker With An Apertured Molded Cross Bar For Supporting A Movable Electrical Contract Arm; Ser. No. 562,648 filed by Robert H. Flick and Walter K. Huffman and entitled Molded Case Circuit Breaker With Movable Upper Electrical Contact Positioned By Tension Springs Ser. No. 562,644 filed by Alfred E. Maier and entitled Molded Case Circuit Breaker With Adjustable Stationary Lower Electrical Contact Ser. No. 562,602 filed by Robert H. Flick and Walter K. Huffman and entitled Molded Case Circuit Breaker With Movable Lower Electrical Contact and Ser. No. 562,603 filed by Robert H. Flick and Walter K. Huffman and entitled Molded Case Circuit Breaker With Movable Upper Electrical Contact Positioned By Torsion Springs.

BACKGROUND OF THE INVENTION

A. Field of the Invention

The device of the present invention generally relates to molded case circuit breakers and, more particularly, to operating mechanisms for controlling the mechanical operation of molded case circuit breakers.

B. Description of the Prior Art

Circuit breakers and, more particularly, molded case circuit breakers are old and well known in the prior art. Examples of such devices are disclosed in U.S. Pat. Nos. 3,525,959; 3,614,865; 3,815,059; 3,863,042; 4,077,025; and 4,166,205. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized a trip mechanism for controlling the movement of an overcenter toggle mechanism to separate a pair of electrical contacts upon an overload condition or upon a short circuit or fault current condition. Such trip mechanisms have included a bimetal movable in response to an overload condition to rotate a trip bar, resulting in the movement of the over-center toggle mechanism to open a pair of electrical circuit breaker contacts. Such prior art devices have also utilized an armature movable in response to the flow of short circuit or fault current to similarly rotate the trip bar to cause the pair of contacts to separate. At least some prior art devices use blow-apart contacts to rapidly interrupt the flow of high level short circuit or fault currents.

While many prior art devices have provided adequate protection against fault conditions in an electrical circuit, a need exists for dimensionally small molded case circuit breakers capable of fast, effective and reliable operation. Many operating mechanisms now used to control the mechanical operation of such circuit breakers require relatively large amounts of operating space. A need exists for an operating mechanism for molded case circuit breakers that utilizes a relatively small amount of space yet provides fast, effective and reliable operation for protecting an electrical system against overload or fault current conditions.

SUMMARY OF THE INVENTION

An object of the present invention is to provide a new and improved circuit breaker.

Another object of the present invention is to provide a new an improved molded case circuit breaker having a highly integrated operating mechanism that occupies a relatively small amount of space while providing fast, efficient and reliable operation in protecting an electrical circuit from overload and fault current conditions.

Another object of the present invention is to provide a new and improved over-center toggle mechanism in a molded case circuit breaker that is mechanically configured to ensure the rapid movement of a pair of upper and lower toggle links during a trip operation to effect the rapid separation of a pair of electrical contacts.

Another object of the present invention is to provide a new and improved intermediate latch disposed between a trip bar and a movable, spring biased cradle in a molded case circuit breaker to achieve a rapid response to fault conditions.

Briefly, the present invention relates to a molded case circuit breaker having a highly integrated operating mechanism that occupies a relatively small amount of space while providing fast, effective and reliable operation in protecting an electrical circuit or system from electrical fault conditions. The molded case circuit breaker includes an operating mechanism that utilizes an improved over-center toggle mechanism to achieve the opening and closing of a pair of electrical contacts and a trip mechanism for responding to overload and short circuit or fault current conditions. The operating mechanism includes a pivotable intermediate latch plate having a cradle latch surface at its upper portion, a trip bar latch surface at its lower portion, and a pair of pivot arms disposed between the upper and lower portions and adapted to be received in inverted keystones or apertures formed in a pair of spaced apart side plates that limit the pivotable movement of the intermediate latch plate.

The over-center toggle mechanism includes a pair of upper toggle links and a pair of lower toggle links interconnected by a toggle spring pin. A lower portion of the movable cradle is physically configured to engage the toggle spring pin upon a trip operation for rapidly moving the toggle spring pin from its CLOSED position towards its TRIPPED position. In addition, the upper toggle links include projections formed thereon for physically contacting a rigid stop upon the release of the cradle during a trip operation to accelerate the movements of the upper and lower toggle links, thereby rapidly separating the electrical contacts.

As a safety precaution, the operating mechanism is configured to retain a manually engageable operating handle in its ON position if the electrical contacts are welded together. In addition, if the manually engageable operating handle is physically restricted or obstructed in its ON position, the operating mechanism is configured to enable the electrical contacts to separate upon an overload conditon or upon a short circuit or fault current condition.

BRIEF DESCRIPTION OF THE DRAWING

The above and other objects and advantages and novel features of the present invention will become apparent from the following detailed description of the preferred and alternative embodiments of a molded case circuit breaker illustrated in the accompanying drawing wherein:

FIG. 9 is an enlarged, fragmentary, plan view of the center pole or phase of the device of FIG. 1 taken along line 9—9 of FIG. 3;

FIG. 10 is an enlarged, fragmentary, plan view of the center pole or phase of the device of FIG. 1 taken along line 10—10 of FIG. 3;

FIG. 11 is an enlarged, fragmentary, cross sectional view of a portion of the device of FIG. 1 taken along line 11—11 of FIG. 3;

FIG. 13 is an enlarged, perspective view of the trip bar of the device of FIG. 1;

FIG. 18 is an enlarged, fragmentary, cross sectional view of the device of FIG. 16, depicting the device in its TRIPPED position;

DESCRIPTION OF THE PREFERRED EMBODIMENT

Figure 1:
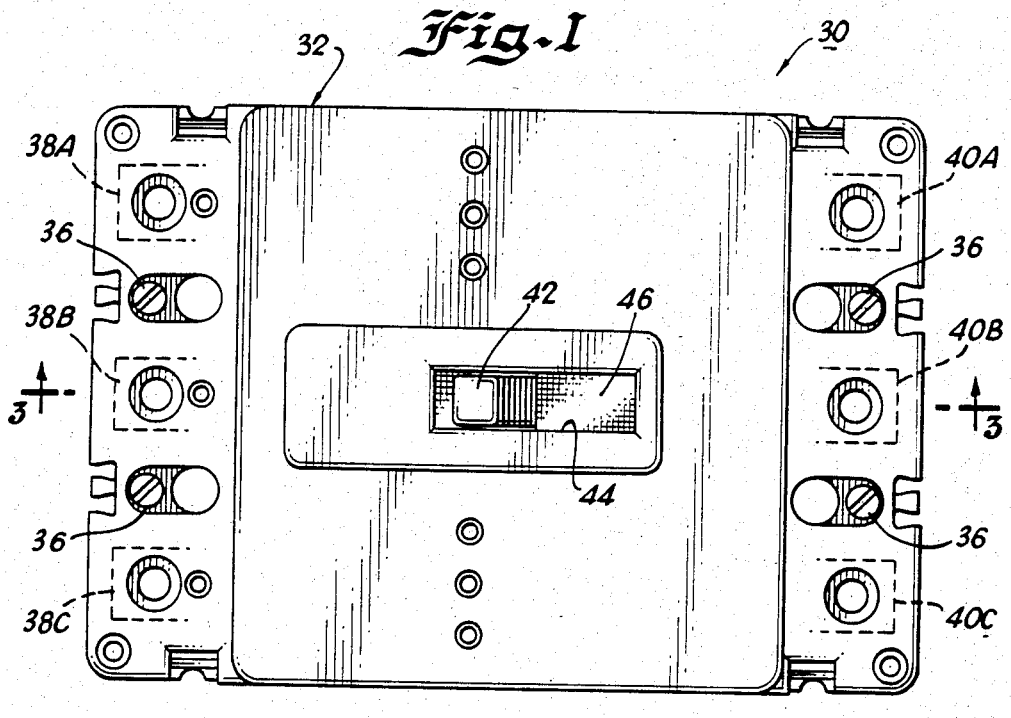
FIG. 1 is a top plan view of a molded case circuit breaker.
Figure 2:
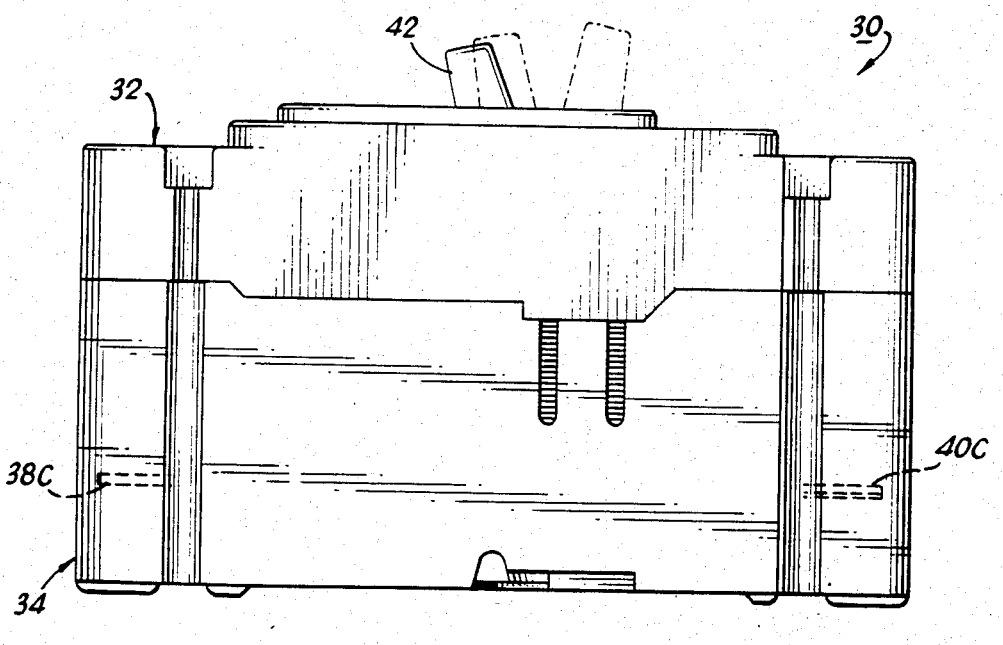
FIG. 2 is a side elevational view of the device of FIG. 1.

Referring to the drawing and initially to FIGS. 1–15, there is illustrated a new and improved molded case circuit breaker 30 constructed in accordance with the principles of the present invention. While the circuit breaker 30 is depicted and described herein as a three phase or three pole circuit breaker, the principles of the present invention disclosed herein are equally applicable to single phase or other polyphase circuit breakers and to both AC circuit breakers and DC circuit breakers.

The circuit breaker 30 includes a molded, electrically insulating, top cover 32 mechanically secured to a molded, electrically insulating, bottom cover or base 34 by a plurality of fasteners 36. A plurality of first electrical terminals or line terminals 38A, 38B and 38C (FIG. 4) are provided, one for each pole or phase, as are a plurality of second electrical terminals or load terminals 40A, 40B and 40C. These terminals are used to serially electrically connect the circuit breaker 30 into a three phase electrical circuit for protecting a three phase electrical system.

Figure 15:
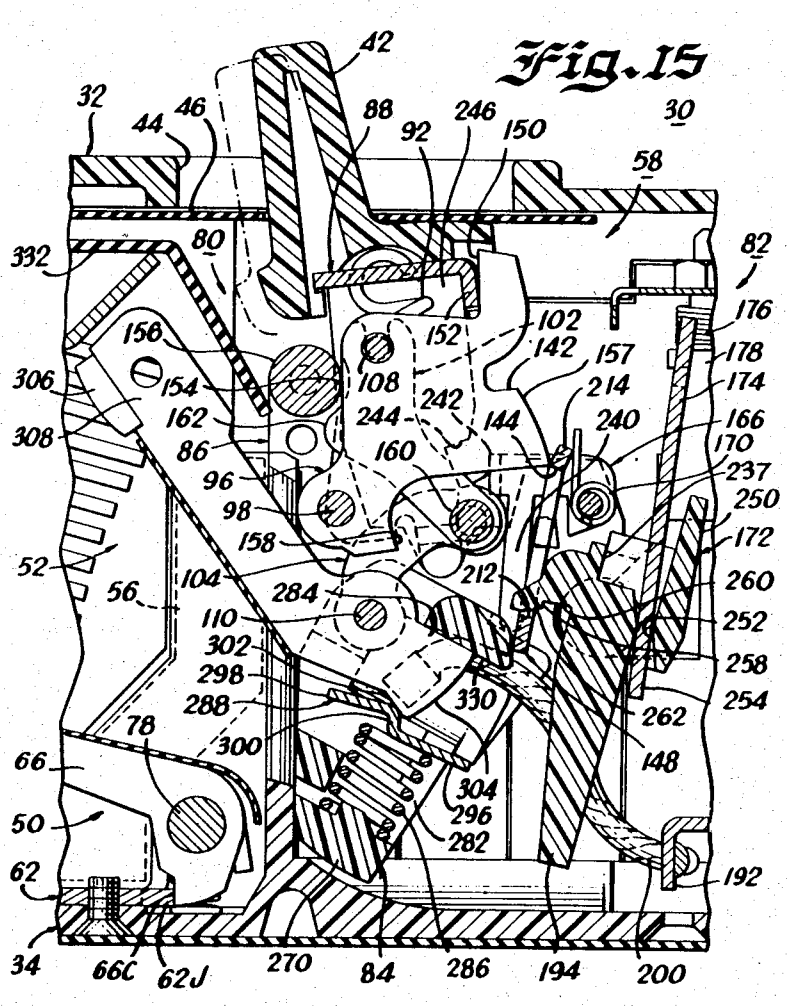
FIG. 15 is an enlarged, fragmentary, cross sectional view of the center pole or phase of the device of FIG. 1, depicting the device in its TRIPPED position.
Figure 14:
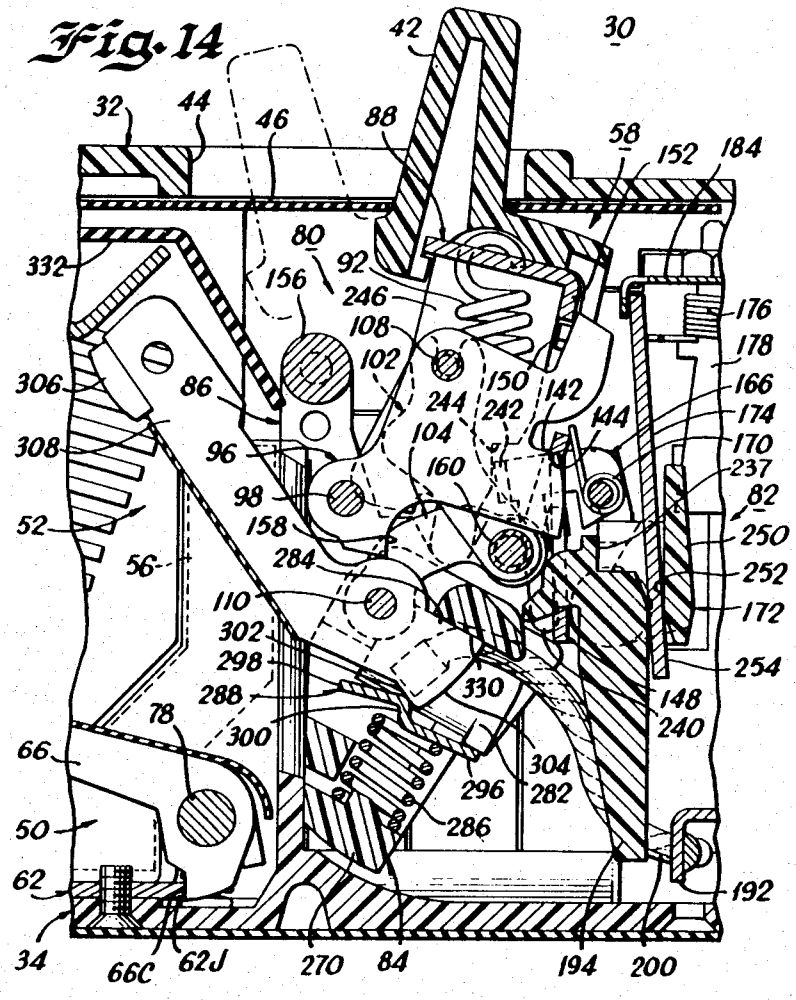
FIG. 14 is an enlarged, fragmentary, cross sectional view of the center pole or phase of the device of FIG. 1, depicting the device in its OPEN position.

The circuit breaker 30 further includes an electrically insulating, rigid, manually engageable handle 42 extending through an opening 44 in the top cover 32 for setting the circuit breaker 30 to its CLOSED position (FIG. 3) or to its OPEN position (FIG. 14). The circuit breaker 30 also may assume a BLOWN-OPEN position (FIG. 3, dotted line position) or a TRIPPED position (FIG. 15). Subsequently to being placed in its TRIPPED position, the circuit breaker 30 may be reset for further protective operation by moving the handle 42 from its TRIPPED position (FIG. 15) past its OPEN position (FIG. 14). The handle 42 may then be left in its OPEN position (FIG. 14) or moved to its CLOSED position (FIG. 3), in which case the circuit breaker 30 is ready for further protective operation. The movement of the handle 42 may be achieved either manually or automatically by a machine actuator. Preferably, an electrically insulating strip 46, movable with the handle 42, covers the bottom of the opening 44 and serves as an electrical barrier between the interior and the exterior of the circuit breaker 30.

As its major internal components, the circuit breaker 30 includes a lower electrical contact 50, an upper electrical contact 52, an electrical arc chute 54, a slot motor 56, and an operating mechanism 58. The arc chute 54 and the slot motor 56 are conventional, per se, and thus are not discussed in detail hereinafter. Briefly, the arc chute 54 is used to divide a single electrical arc formed between separating electrical contacts 50 and 52 upon a fault condition into a series of electrical arcs, increasing the total arc voltage and resulting in a limiting of the magnitude of the fault current. The slot motor 56, consisting either of a series of generally U-shaped steel laminations encased in electrical insulation or of a generally U-shaped, electrically insulated, solid steel bar, is disposed about the contacts 50 and 52 to concentrate the magnetic field generated upon a high level short circuit or fault current condition, thereby greatly increasing the magnetic repulsion forces between the separating electrical contacts 50 and 52 to rapidly accelerate the separation of electrical contacts 50 and 52. The rapid separation of the electrical contacts 50 and 52 results in a relatively high arc resistance to limit the magnitude of the fault current. Reference may be had to U.S. Pat. No. 3,815,059 for a more detailed description of the arc chute 54 and the slot motor 56.

The lower electrical contact 50 (FIGS. 3, 4 and 11) includes a lower, formed, stationary member 62 secured to the base 34 by a fastener 64, a lower movable contact arm 66, a pair of electrical contact compression springs 68, a lower contact biasing means or compression spring 70, a contact 72 for physically and electrically contacting the upper electrical contact 52 and an electrically insulating strip 74 to reduce the possibility of arcing between the upper electrical contact 52 and portions of the lower electrical contact 50. The line terminal 38B extending exteriorly of the base 34 comprises an integral end portion of the member 62. The member 62 includes an inclined portion 62A that serves as a lower limit or stop for the moving contact arm 66 during its blow-open operation; an aperture 62B overlying a recess 76 formed in the base 34 for seating the compression spring 70; and a lower flat section 62C through which the aperture 62B is formed. The flat section 62C may also include a threaded aperture 62D formed therethrough for receiving the fastener 64 to secure the stationary member 62 and thus the lower electrical contact 50 to the base 34. The stationary member 62 includes a pair of spaced apart, integrally formed, upstanding, generally curved or U-shaped contacting portions 62E and 62F. The contacting portions 62E and 62F each include two, spaced apart, flat, inclined surfaces 62G and 62H, inclined at an angle of approximately 45 degrees to the plane of the lower flat section 62C and extending laterally across the inner surfaces of the contacting portions 62E and 62F. A stop 62J (FIG. 4) is provided for limiting the upward movement of the contact arm 66.

The contact arm 66 is fixedly secured to a rotatable pin 78 (FIG. 11) for rotation therewith within the curved contacting portions 62E and 62F about the longitudinal axis of the rotatable pin 78. The rotatable pin 78 includes outwardly extending round contacting portions 78A and 78B that are biased by the compression springs 68 into effective current conducting contact with the surfaces 62G and 62H of the portions 62F and 62E, respectively. In this manner, effective conductive contact and current transfer is achieved between the lower formed stationary member 62 and the lower movable contact arm 66 through the rotatable pin 78. The lower movable contact arm 66 includes an elongated rigid lever arm 66A extending between the rotatable pin 78 and the contact 72 and a downwardly protuberant portion or spring locator 66B for receipt within the upper end of the compression spring 70 for maintaining effective contact between the lower movable arm 66 and the compression spring 70. Finally, the lower movable contact arm 66 includes an integrally formed, flat surface 66C formed at its lower end for contacting the stop 62J to limit the upward movement of the lower movable contact arm 66 and the contact 72 fixedly secured thereto.

Figure 3:
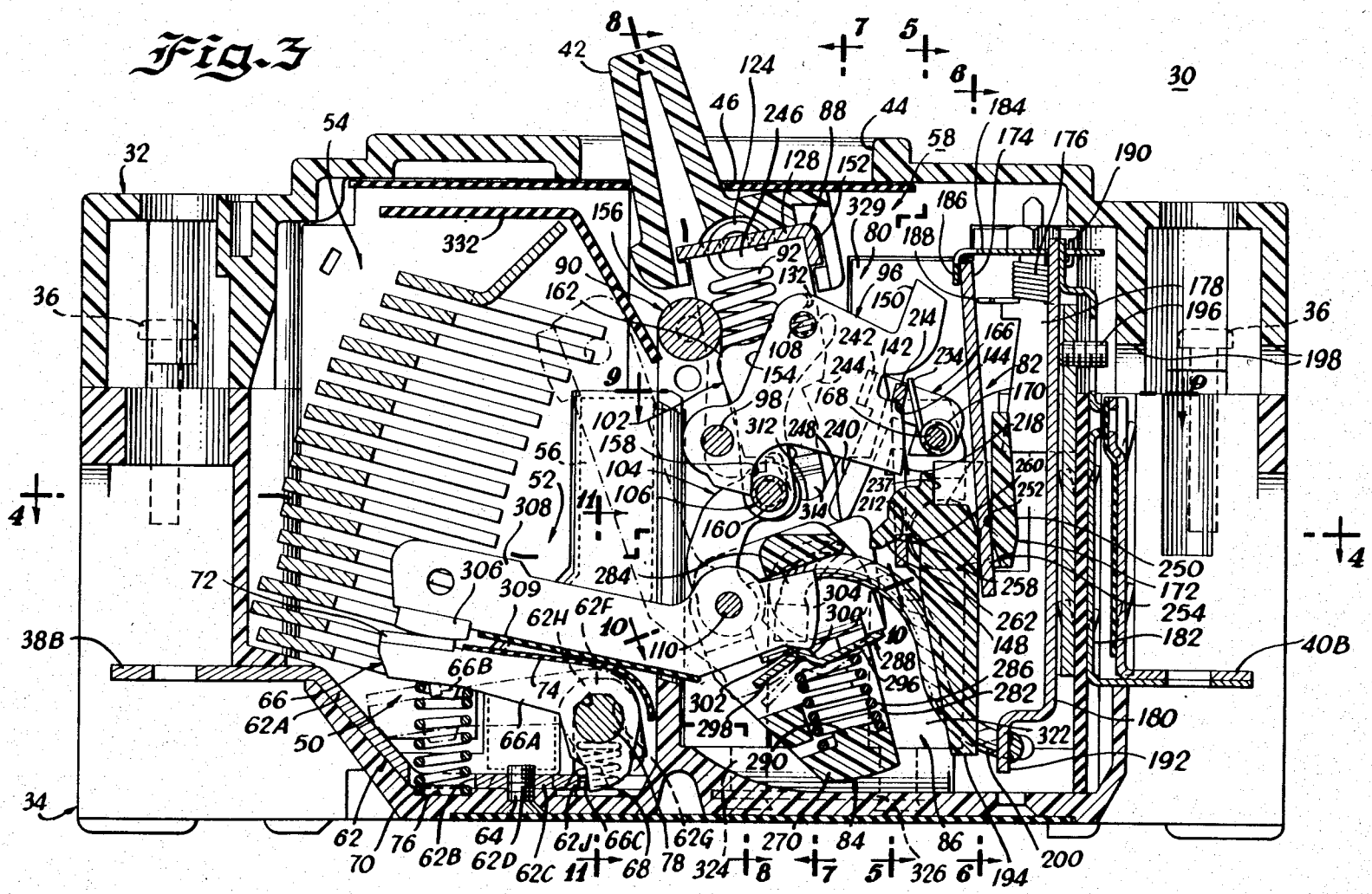
FIG. 3 is an enlarged, cross sectional view of the device of FIG. 1 taken along line 3—3 of FIG. 1, depicting the device in its CLOSED and BLOWN-OPEN positions.
Figure 4:
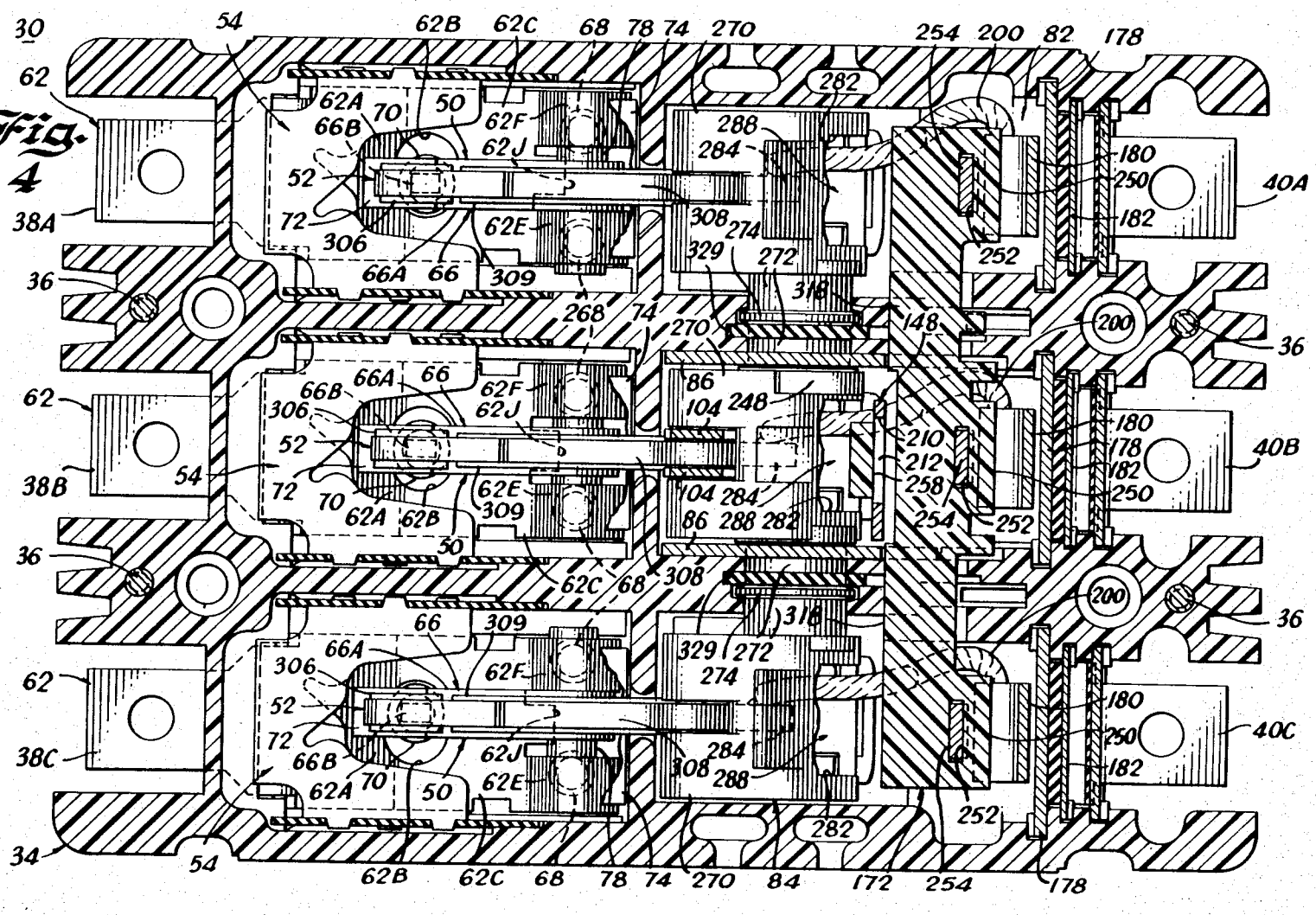
FIG. 4 is an enlarged, plan sectional view of the device of FIG. 1 taken along line 4—4 of FIG. 3.

The lower electrical contact 50 as described hereinabove utilizes the high magnetic repulsion forces generated by high level short circuit or fault current flowing through the elongated parallel portions of the electrical contacts 50 and 52 to cause the rapid downward movement of the contact arm 66 against the bias of the compression spring 70 (FIG. 3). An extremely rapid separation of the electrical contacts 50 and 52 and a resultant rapid increase in the resistance across the electrical arc formed between the electrical contacts 50 and 52 is thereby achieved, providing effective fault current limitation within the confines of relatively small physical dimensions. The lower electrical contact 50 further eliminates the necessity for utilizing flexible copper shunts used in many prior art molded case circuit breakers for providing a current carrying conductive path between a terminal of the circuit breaker and a lower movable contact arm of a lower electrical contact. The use of the compression springs 68 to provide a constant bias against the pin 78 provides an effective current path between the terminal 38B and the contact 72 while enabling the mounting of the lower electrical contact 50 in a small, compact area.

The operating mechanism 58 includes an over-center toggle mechanism 80; a trip mechanism 82; an integral or one-piece molded cross bar 84 (FIG. 12); a pair of rigid, opposed or spaced apart, metal side plates 86; a rigid, pivotable, metal handle yoke 88; a rigid stop pin 90; and a pair of operating tension springs 92.

The over-center toggle mechanism 80 includes a rigid, metal cradle 96 that is rotatable about the longitudinal central axis of a cradle support pin 98. The opposite longitudinal ends of the cradle support pin 98 in an assembled condition are retained in a pair of apertures 100 formed through the side plates 86.

The toggle mechanism 80 further includes a pair of upper toggle links 102, a pair of lower toggle links 104, a toggle spring pin 106 and an upper toggle link follower pin 108. The lower toggle links 104 are secured to the upper electrical contact 52 by a toggle contact pin 110. Each of the lower toggle links 104 includes a lower aperture 112 for receipt therethrough of the toggle contact pin 110. The toggle contact pin 110 also passes through an aperture 114 formed through the upper electrical contact 52 enabling the upper electrical contact 52 to freely rotate about the central longitudinal axis of the pin 110. The opposite longitudinal ends of the pin 110 are received and retained in the cross bar 84. Thus, movement of the upper electrical contact 52 under other than high level short circuit or fault current conditions and the corresponding movement of the cross bar 84 is effected by movement of the lower toggle links 104. In this manner, movement of the upper electrical contact 52 by the operating mechanism 58 in the center pole or phase of the circuit breaker 30 simultaneously, through the rigid cross bar 84, causes the same movement in the upper electrical contacts 52 associated with the other poles or phases of the circuit breaker 30.

Each of the lower toggle links 104 also includes an upper aperture 116; and each of the upper toggle links 102 includes an aperture 118. The pin 106 is received through the apertures 116 and 118, thereby interconnecting the upper and lower toggle links 102 and 104 and allowing rotational movement therebetween. The opposite longitudinal ends of the pin 106 include journals 120 for the receipt and retention of the lower, hooked or curved ends 122 of the springs 92. The upper, hooked or curved ends 124 of the springs 92 are received through and retained in slots 126 formed through an upper, planar or flat surface 128 of the handle yoke 88. At least one of the slots 126 associated with each spring 92 includes a locating recess 130 for positioning the curved ends 124 of the springs 92 to minimize or prevent substantial lateral movement of the springs 92 along the lengths of the slots 126.

In an assembled condition, the disposition of the curved ends 124 within the slots 126 and the disposition of the curved ends 122 in the journals 120 retain the links 102 and 104 in engagement with the pin 106 and also maintain the springs 92 under tension, enabling the operation of the over-center toggle mechanism 80 to be controlled by and responsive to external movements of the handle 42.

The upper links 102 also include recesses or grooves 132 for receipt in and retention by a pair of spaced apart journals 134 formed along the length of the pin 108. The center portion of the pin 108 is configured to be received in an aperture 136 formed through the cradle 96 at a location spaced by a predetermined distance from the axis of rotation of the cradle 96. Spring tension from the springs 92 retains the pin 108 in engagement with the upper toggle links 102. Thus, rotational movement of the cradle 96 effects a corresponding movement or displacement of the upper portions of the links 102.

The cradle 96 includes a slot or groove 140 having an inclined flat latch surface 142 formed therein. The surface 142 is configured to engage an inclined flat cradle latch surface 144 formed at the upper end of an elongated slot or aperture 146 formed through a generally flat, intermediate latch plate 148. The cradle 96 also includes a generally flat handle yoke contacting surface 150 configured to contact a downwardly depending elongated surface 152 formed along one edge of the upper surface 128 of the handle yoke 88. The operating springs 92 move the handle 42 during a trip operation; and the surfaces 150 and 152 locate the handle 42 in a TRIPPED position (FIG. 15), intermediate the CLOSED position (FIG. 3) and the OPEN position (FIG. 14) of the handle 42, to indicate that the circuit breaker 30 has tripped. In addition, the engagement of the surfaces 150 and 152 resets the operating mechanism 58 subsequent to a trip operation by moving the cradle 96 in a clockwise direction against the bias of the operating springs 92 from its TRIPPED position (FIG. 15) to and past its OPEN position (FIG. 14) to enable the relatching of the surfaces 142 and 144.

The cradle 96 further includes a generally flat elongated stop surface 154 for contacting a peripherally disposed, radially outwardly protuberant portion or rigid stop 156 formed about the center of the stop pin 90. The engagement of the surface 154 with the rigid stop 156 limits the movement of the cradle 96 in a counterclockwise direction subsequent to a trip operation (FIG. 15). The cradle 96 also includes a curved, intermediate latch plate follower surface 157 for maintaining contact with the outermost edge of the inclined latch surface 144 of the intermediate latch plate 148 upon the disengagement of the latch surfaces 142 and 144 during a trip operation (FIG. 15). An impelling surface of kicker 158 is also provided on the cradle 96 for engaging a radially outwardly projecting portion or contacting surface 160 formed on the pin 106 upon the release of the cradle 96 to immediately and rapidly propel the pin 106 in a counterclockwise arc from an OPEN position (FIG. 3) to a TRIPPED position (FIG. 15), thereby rapidly raising and separating the upper electrical contact 52 from the lower electrical contact 50.

During such a trip operation, an enlarged portion or projection 162 formed on the upper toggle links 102 is designed to contact the stop 156 with a considerable amount of force provided by the operating springs 92 through the rotating cradle 96, thereby accelerating the arcuate movements of the upper toggle links 102, the toggle spring pin 106 and the lower toggle links 104. In this manner, the speed of operation or the response time of the operating mechanism 58 is significantly increased.

The trip mechanism 82 includes the intermediate latch plate 148, a movable or pivotable handle yoke latch 166, a torsion spring spacer pin 168, a double acting torsion spring 170, a molded, integral or one-piece trip bar 172 (FIG. 13), an armature 174, an armature torsion spring 176, a magnet 178, a bimetal 180 and a conductive member or heater 182. The bimetal 180 is electrically connected to the terminal 40B through the conductive member 182. The magnet 178 physically surrounds the bimetal 180 thereby establishing a magnetic circuit to provide a response to short circuit or fault current conditions. An armature stop plate 184 has a downwardly depending edge portion 186 that engages the upper end of the armature 174 to limit its movement in the counterclockwise direction. The torsion spring 176 has one longitudinal end formed as an elongated spring arm 188 for biasing the upper portion of the armature 174 against movement in a clockwise direction. An opposite, upwardly disposed, longitudinal end 190 of the torsion spring 176 is disposed in one of a plurality of spaced apart apertures (not illustrated) formed through the upper surface of the plate 184. The spring tension of the spring arm 188 may be adjusted by positioning the end 190 of the torsion spring 176 in a different one of the apertures formed through the upper surface of the support plate 184.

The bimetal 180 includes a formed lower end 192 spaced by a predetermined distance from the lower end of a downwardly depending contact leg 194 of the trip bar 172 (FIG. 3). The spacing between the end 192 and the leg 194 when the circuit breaker 30 is in a CLOSED position (FIG. 3) may be adjusted to change the response time of the circuit breaker 30 to overload conditions by appropriately turning a set screw 196, access to which may be provided by apertures 198 formed through the top cover 32. A current carrying conductive path between the lower end 192 of the bimetal 180 and the upper electrical contact 52 is achieved by a flexible copper shunt 200 connected by any suitable means, for example, by brazing, to the lower end 192 of the bimetal 180 and to the upper electrcial contact 52 within the cross bar 84. In this manner, an electrical path is provided through the circuit breaker 30 between the terminals 38B and 40B via the lower electrical contact 50, the upper electrical contact 52, the flexible shunt 200, the bimetal 180 and the conductive member 182.

In addition to the cradle latch surface 144 formed at the upper end of the elongated slot 146, the intermediate latch plate 148 includes a generally square shaped aperture 210, a trip bar latch surface 212 at the lower portion of the aperture 210, an upper inclined flat portion 214 and a pair of oppositely disposed laterally extending pivot arms 216 configured to be received within inverted keystones or apertures 218 formed through the side plates 86. The configuration of the apertures 218 is designed to limit the pivotable movement of the pivot arms 216 and thus of the intermediate latch plate 148.

The handle yoke latch 166 includes an aperture 220 for receipt therethrough of one longitudinal end 222 of the pin 168. The handle yoke latch 166 is thus movable or pivotable about the longitudinal axis of the pin 168. An opposite longitudinal end 224 of the pin 168 and the end 222 are designed to be retained in a pair of spaced apart apertures 226 formed through the side plates 86. Prior to the receipt of the end 224 in the aperture 226, the pin 168 is passed through the torsion spring 170 to mount the torsion spring 170 about an intermediately disposed raised portion 228 of the pin 168. One longitudinal end of the body of the torsion spring 170 is received against an edge 230 of a raised portion 232 of the pin 168 to retain the torsion spring 170 in a proper operating position. The torsion spring 170 includes an elongated, upwardly extending spring arm 234 for biasing the flat portion 214 of the intermediate latch plate 148 for movement in a counterclockwise direction for resetting the intermediate latch plate 148 subsequently to a trip operation by the overcenter toggle mechanism 80 and a downwardly extending spring arm 236 for biasing an upper portion or surface 237 of the trip bar 172 against rotational movement in a clockwise direction (FIG. 3).

The handle yoke latch 166 includes an elongated downwardly extending latch leg 240 and a bent or outwardly extending handle yoke contacting portion 242 (FIGS. 9 and 12) that is physically disposed to be received in a slotted portion 244 formed in and along the length of one of a pair of downwardly depending support arms 246 of the handle yoke 88 during a reset operation (FIG. 14). The engagement of the aforementioned downwardly depending support arm 246 by the handle yoke latch 166 prohibits the handle yoke 88 from traveling to its reset position if the contacts 72 and 306 are welded together. If the contacts 72 and 306 are not welded together, the crossbar 84 rotates to its TRIPPED position (F(G. 15); and the handle yoke latch 166 rotates out of the path of movement of the downwardly depending support arm 246 of the handle yoke 88 and into the slotted portion 244 to enable the handle yoke 88 to travel to its reset position, past its OPEN position (FIG. 14). An integrally molded outwardly projecting surface 248 on the cross bar 84 is designed to engage and move the latch leg 240 of the handle yoke latch 166 out of engagement with the handle yoke 88 during the movement of the cross bar 84 from its OPEN position (FIG. 14) to its CLOSED position (FIG. 3).

Preferably, the trip bar 172 is formed as a molded, integral or one-piece trip bar 172 having three, spaced apart downwardly depending contact legs 194, one such contact leg 194 being associated with each pole or phase of the circuit breaker 30. In addition, the trip bar 172 includes three, enlarged armature support sections 250, one such support section 250 for each pole or phase of the circuit breaker 30. Each of the support sections 250 includes an enlongated, generally rectangularly shaped slot or pocket 252 formed therethrough (FIGS. 6 and 9) for receiving a downwardly depending trip leg 254 of the armature 174. The armature 174 includes outwardly extending edges or shoulder portions 256 for engaging the upper surfaces of the pockets 252 to properly seat the armature 174 in the trip bar 172. Each trip leg 254 is designed to engage and rotate an associated contact leg 194 of the trip bar 172 in a clockwise direction (FIG. 15) upon the occurrence of a short circuit or fault current condition.

The trip bar 172 also includes a latch surface 258 (FIG. 3) for engaging and latching the trip bar latch surface 212 of the intermediate latch plate 148. The latch surface 258 is disposed between a generally horizontally disposed surface 260 and a separate, inclined surface 262 of the trip bar 172. The latch surface 258 (FIG. 3) is a vertically extending surface having a length determined by the desired response characteristics of the operating mechanism 58 to an overload condition or to a short circuit or fault current condition. In a specific embodiment of the present invention, an upward movement of the surface 260 of approximately one-half millimeter is sufficient to unlatch the surfaces 258 and 212. Such unlatching results in movement between the cradle 96 and the intermediate latch plate 148 along the surfaces 142 and 144, immediately unlatching the cradle 96 from the intermediate latch plate 148 and enabling the counterclockwise rotational movement of the cradle 96 and a trip operation of the circuit breaker 30. During a reset operation, the spring arm 236 of the torsion spring 170 engages the surface 237 of the trip bar 172, causing the surface 237 to rotate counterclockwise to enable the latch surface 258 of the trip bar 172 to engage and relatch with the latch surface 212 of the intermediate latch plate 148 to reset the intermediate latch plate 148, the trip bar 172 and the circuit breaker 30. The length of the curved surface 157 of the cradle 96 should be sufficient to retain contact between the upper portion 214 of the intermediate latch plate 148 and the cradle 96 to prevent resetting of the intermediate latch plate 148 and the trip bar 172 until the latch surface 142 of the cradle 96 is positioned below the latch surface 144 of the intermediate latch plate 148. Preferably, each of the three poles or phases of the circuit breaker 30 is provided with a bimetal 180, an armature 174 and a magnet 178 for displacing an associated contact leg 194 of the trip bar 172 as a result of the occurrence of an overload condition or of a short circuit or fault current condition in any one of the phases to which the circuit breaker 30 is connected.

In addition to the integral projecting surface 248, the cross bar 84 includes three enlarged sections 270 (FIG. 12) separated by round bearing surfaces 272. A pair of peripherally disposed, outwardly projecting locators 274 are provided to retain the cross bar 84 in proper position within the base 36. The base 36 includes bearing surfaces 276 (FIG. 7) complementarily shaped to the bearing surfaces 272 for seating the cross bar 84 for rotational movement in the base 34. The locators 274 are received within arcuate recesses or grooves 278 formed along the surfaces 276. Each enlarged section 270 further includes a pair of spaced apart apertures 280 (FIG. 10) for receiving the toggle contact pin 110. The pin 110 may be retained within the apertures 280 by any suitable means, for example, by an interference fit therebetween.

Each enlarged section 270 also includes a window, pocket or fully enclosed opening 282 formed therein (FIG. 12) for receipt of one longitudinal end or base portion 284 of the upper electrical contact 52 (FIG. 3). The opening 282 also permits the receipt and retention of a contact arm compression spring 286 (FIG. 12) and an associated, formed, spring follower 288. The compression spring 286 is retained in proper position within the enlarged section 270 by being disposed about an integrally formed, upwardly projecting boss 290.

The spring follower 288 is configured to be disposed between the compression spring 286 and the base portion 284 of the upper electrical contact 52 to transfer the compressive force from the spring 286 to the base portion 284, thereby ensuring that the upper electrical contact 52 and the cross bar 84 move in unison. The spring follower 288 includes a pair of spaced apart generally J-shaped grooves 292 formed therein for receipt of a pair of complementarily shaped, elongated ridges or shoulder portions 294 to properly locate the retain the spring follower 288 in the enlarged section 270. A first generally planar portion 296 is located at one end of the spring follower 288; and a second planar portion 298 is located at the other longitudinal end of the spring follower 288 and is spaced from the portion 296 by a generally flat inclined portion 300.

The shape of the spring follower 288 enables it to engage the base portion 284 of the upper electrical contact 52 with sufficient spring force to ensure that the upper electrical contact 52 follows the movement of the cross bar 84 in response to operator movements of the handle 42 or the operation of the operating mechanism 58 during a normal trip operation. However, upon the occurrence of a high level short circuit or fault current condition, the upper electrical contact 52 can rotate about the pin 110 by deflecting the spring follower 288 downwardly (FIG. 3), enabling the electrical contacts 50 and 52 to rapidly separate and move to their BLOWN-OPEN positions (FIG. 3) without waiting for the operating mechanism 58 to sequence. This independent movement of the upper electrical contact 52 under the above high fault condition is possible in any pole or phase of the circuit breaker 30.

During normal operating conditions, an inclined surface 302 of the base portion 284 of the upper electrical contact 52 contacts the inclined portion 300 or the junction between the portions 298 and 300 of the spring follower 288 to retain the cross bar 84 in engagement with the upper electrical contact 52. However, upon the occurrence of a high level short circuit or fault current condition, the inclined surface 302 is moved past and out of engagement with the portions 298 and 300; and a terminal portion or surface 304 of the base portion 284 engages the downwardly deflected planar portion 298 of the spring follower 288 to retain the upper electrical contact 52 in its BLOWN-OPEN position, thereby eliminating or minimizing the possibility of contact restrike. Subsequently, when the circuit breaker 30 trips, the upper electrical contact 52 is forced by the operating mechanism 58 against the stop 156 to reset the upper electrical contact 52 for movement in unison with the cross bar 84. During this resetting operation, the surface 304 is moved out of engagement with the portion 298 and the inclined portion 302 is moved back into engagement with the spring follower 288. By changing the configuration of the spring follower 288 or the configuration of the surfaces 302, 304 of the base portion 284 of the upper electrical contact 52, the amount of upward travel of the upper electrical contact 52 during a BLOWN-OPEN operation required to bring the surface 304 into contact with the spring follower 288 can be altered as desired.

The openings 282 formed in the enlarged sections 270 of the cross bar 84 permit the passage of the flexible shunts 200 therethrough without significantly reducing the strength of the cross bar 84. Since the flexible shunts 200 pass through the openings 282 adjacent the axis of rotation of the cross bar 84, minimum flexing of the flexible shunts 200 occur, increasing the longevity and reliability of the circuit breaker 30.

The upper electrical contact 52 also includes a contact 306 for physically and electrically contacting the contact 72 of the lower electrical contact 50 and an upper movable elongated contact arm 308 disposed between the contact 306 and the base portion 284. It is the passage of high level short circuit or fault current through the generally parallel contact arms 66 and 308 that causes very high magnetic repulsion forces between the contact arms 66 and 308, effecting the extremely rapid separation of the contacts 72 and 306. An electrically insulating strip 309 may be used to electrically insulate the upper contact arm 308 from the lower contact arm 66.

Figures 5, 6:
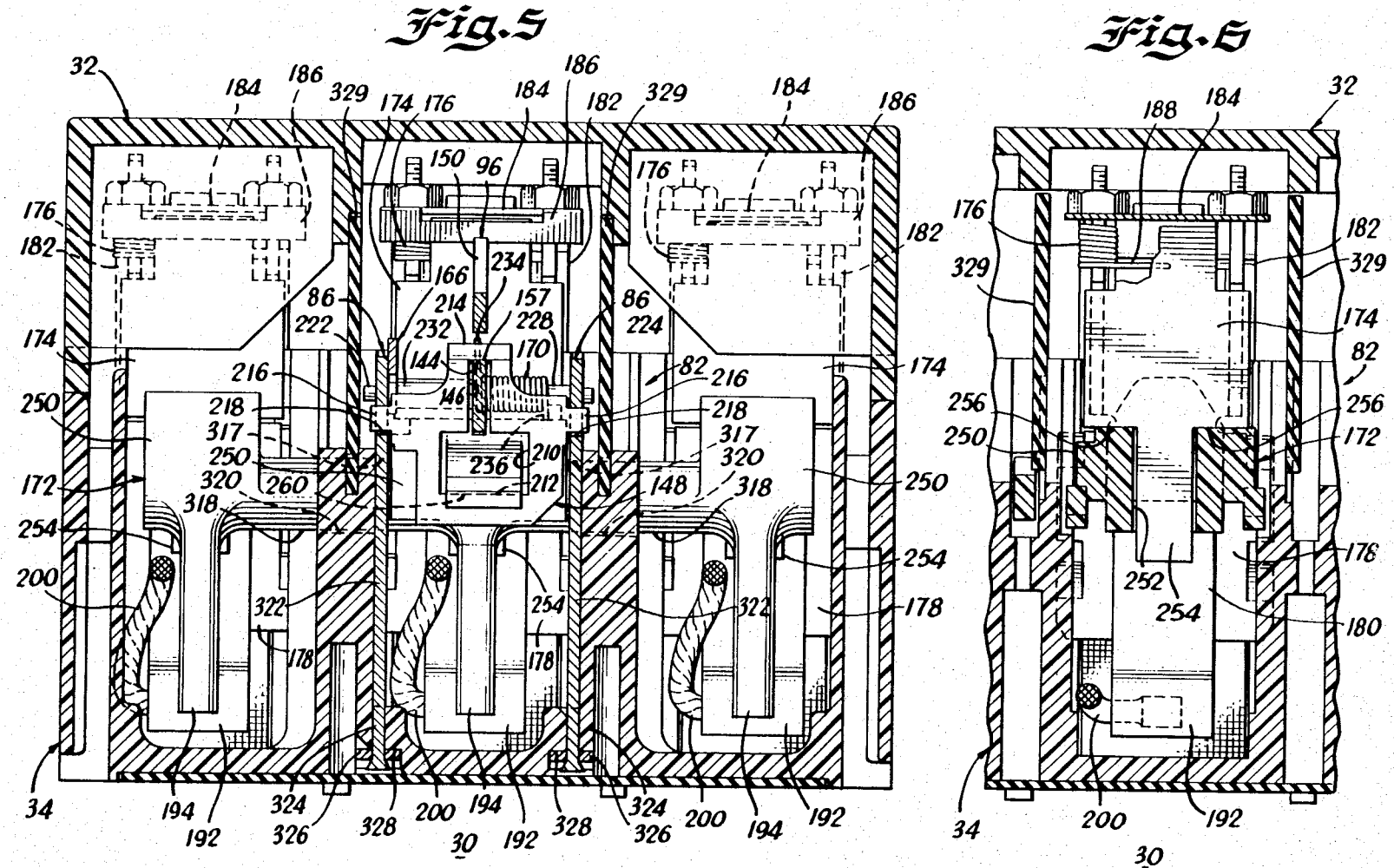
FIG. 5 is an enlarged, cross sectional view of the device of FIG. 1 taken along line 5—5 of FIG. 3.
FIG. 6 is an enlarged, fragmentary, cross sectional view of the center pole or phase of the device of FIG. 1 taken along line 6—6 of FIG. 3.
Figure 8:
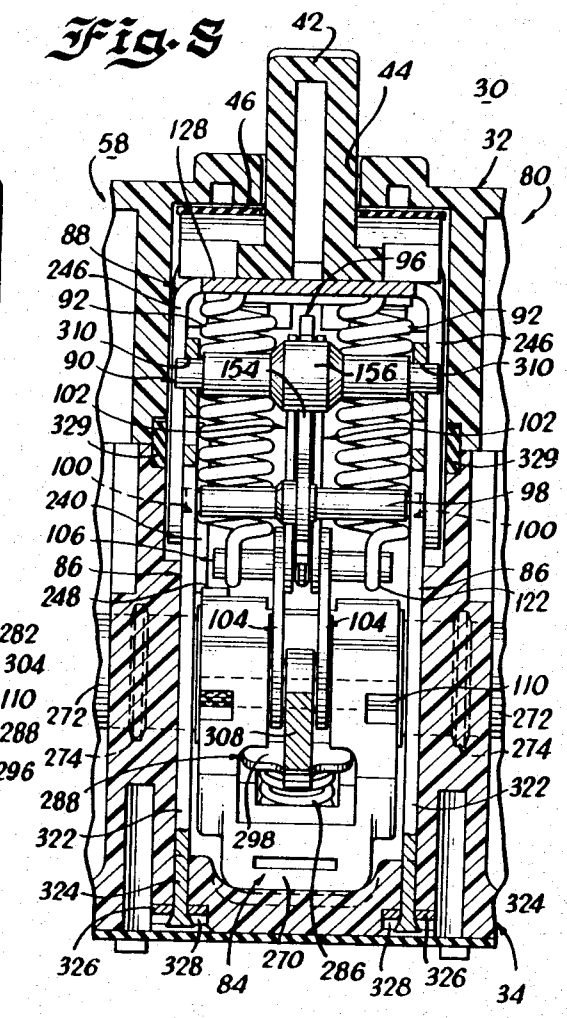
FIG. 8 is an enlarged, fragmentary, cross sectional view of the center pole or phase of the device of FIG. 1 taken along line 8—8 of FIG. 3.
Figure 7:
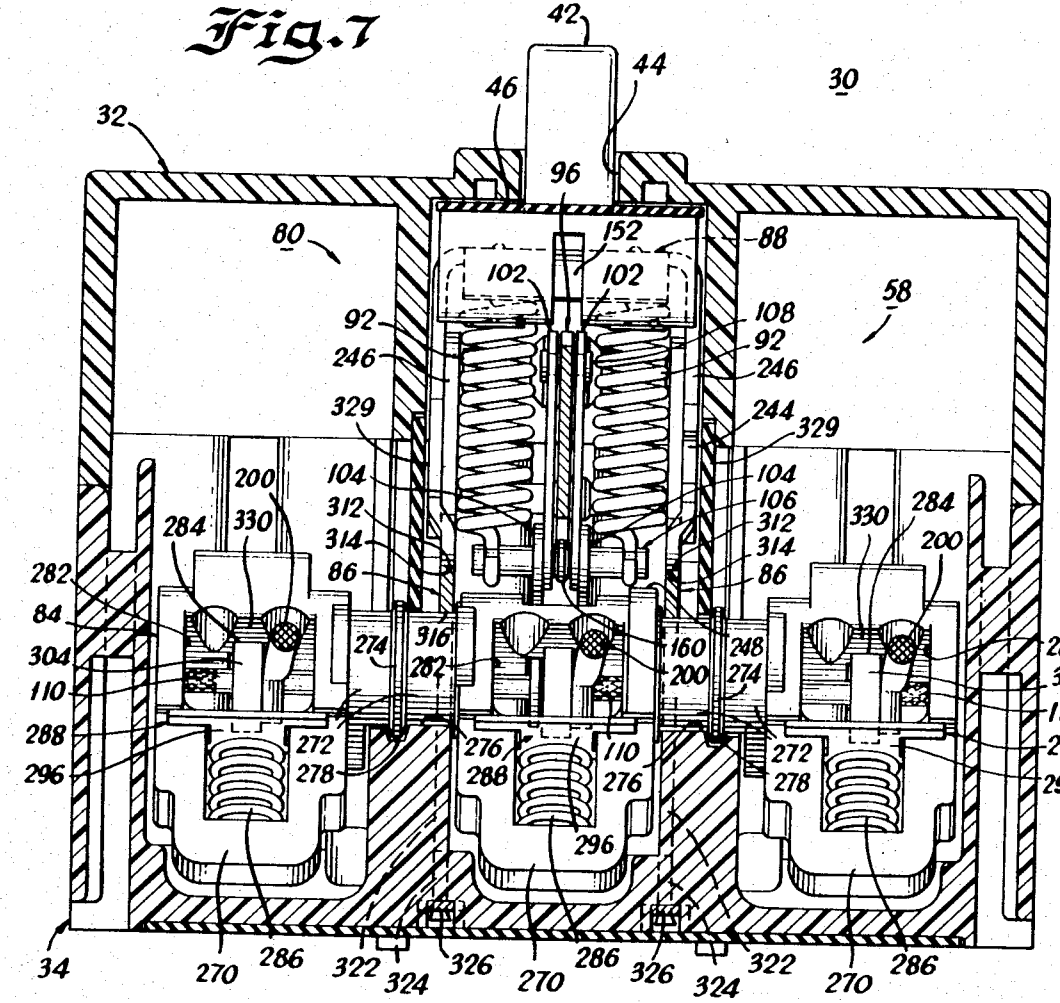
FIG. 7 is an enlarged, cross sectional view of the device of FIG. 1 taken along line 7—7 of FIG. 3.
Figure 12:
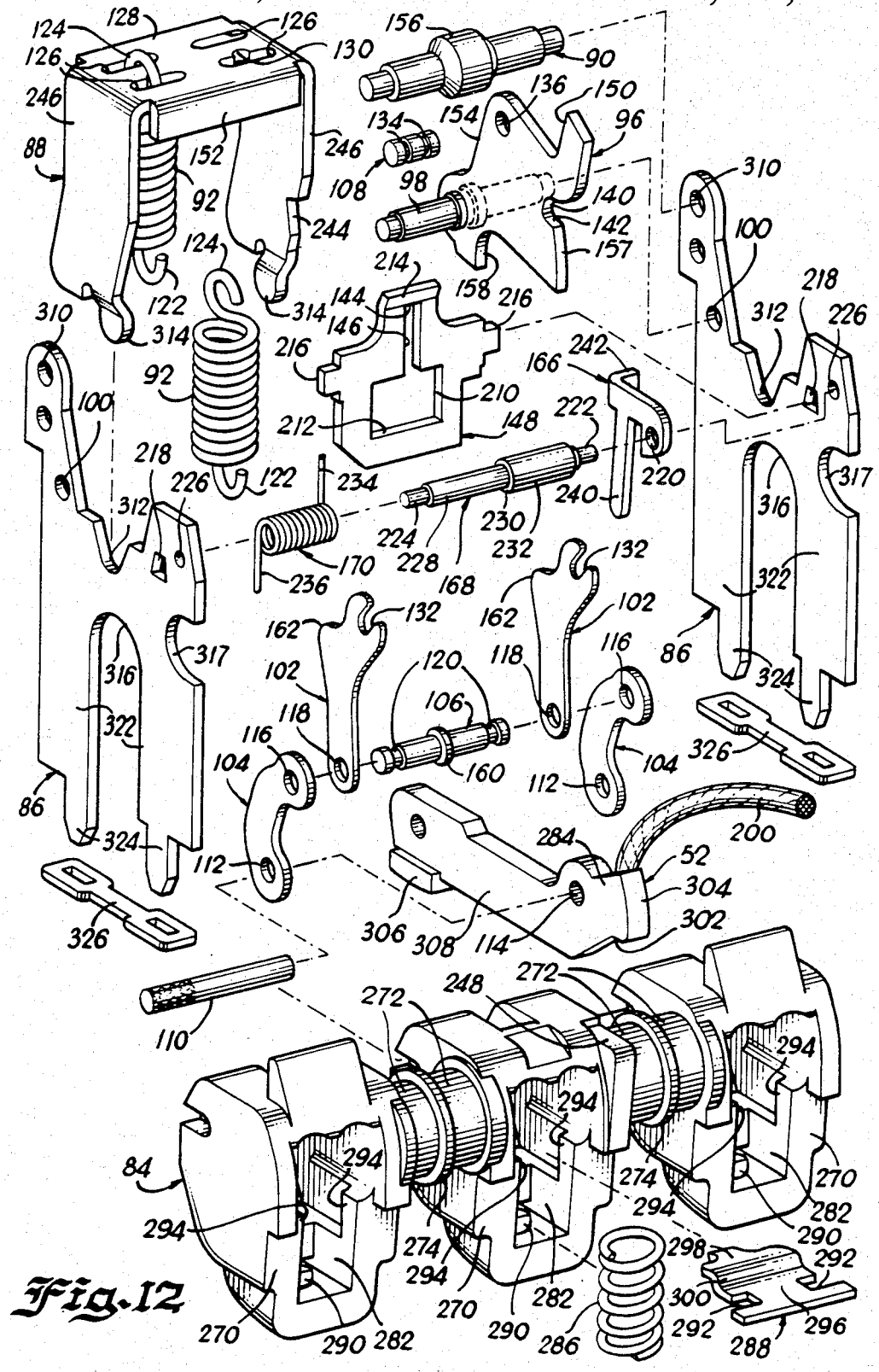
FIG. 12 is an enlarged, exploded, perspective view of portions of the operating mechanism of the device of FIG. 1.

In addition to the apertures 100, 218 and 226, the side plates 86 include apertures 310 for the receipt and retention of the opposite ends of the stop pin 90. In addition, bearing or pivot surfaces 312 are formed along the upper portion of the side plates 86 for engagement with a pair of bearing surfaces or round tabs 314 formed at the lowermost extremities of the downwardly depending support arms 246 of the handle yoke 88. The handle yoke 88 is thus controllably pivotal about the bearing surfaces 314 and 312. The side plates 86 also include bearing surfaces 316 (FIGS. 7 and 12) for contacting the upper portions of the bearing surfaces 272 of the cross bar 84 and for retaining the cross bar 84 securely in position within the base 34. The side plates 86 include generally C-shaped bearing surfaces 317 configured to engage a pair of round bearing surfaces 318 disposed between the support sections 250 of the trip bar 172 for retaining the trip bar 172 in engagement with a plurality of retaining surfaces 320 (FIG. 5) integrally formed as part of the molded base 34. Each of the side plates 86 includes a pair of downwardly depending support arms 322 that terminate in elongated, downwardly projecting stakes or tabs 324 for securely retaining the side plates 86 in the circuit breaker 30. Associated with the tabs 324 are apertured metal plates 326 that are configured to be received in recesses 328 (FIGS. 5, 7 and 8). In assembling the support plates 86 in the circuit breaker 30, the tabs 324 are passed through apertures formed through the base 34 and, after passing through the apertured metal plates 326, are positioned in the recesses 328. The tabs 324 may then be mechanically deformed, for example, by peening, to lock the tabs 324 in engagement with the apertured metal plates 326, thereby securely retaining the side plates 86 in engagement with the base 34. A pair of formed electrically insulating barriers 329 (FIGS. 5 through 8) is used to electrically insulate conductive components and surfaces in one pole or phase of the circuit breaker 30 from conductive components or surfaces in an adjacent pole or phase of the circuit breaker 30.

In operation; the circuit breaker 30 may be interconnected in a three phase electrical circuit via line and load connections to the terminals 38A, B and C and 40A, B and C. The operating mechanism 58 may be set by moving the handle 42 from its TRIPPED position (FIG. 15) as far as possible past its OPEN position (FIG. 14) to ensure the resetting of the intermediate latch plate 148, the cradle 96 and the trip bar 172 by the engagement of the latching surfaces 142 and 144 and by the engagement of the latch surfaces 212 and 258. The handle 42 may then be moved from its OPEN position (FIG. 14) to its CLOSED position (FIG. 3) causing the operating mechanism 58 to close the contacts 72 and 306; and the circuit breaker 30 is then ready for operation in protecting a three phase electrical circuit. If, due to a prior overload condition, the bimetal 180 remains heated and deflects the contact leg 194 of the trip bar 172 sufficiently to prevent the latching of the surface 212 with the surface 258, the handle 42 will return to its TRIPPED position (FIG. 15); and the electrical contacts 50 and 52 will remain separated. After the bimetal 180 has returned to its normal operating temperature, the operating mechanism 58 may be reset as described above.

Upon the occurrence of a sustained overload condition, the formed lower end 192 of the bimetal 180 deflects along a clockwise arc and eventually deflects the contact leg 194 of the trip bar 182 sufficiently to unlatch the intermediate latch plate 148 from the trip bar 172, resulting in immediate relative movement between the cradle 96 and the intermediate latch plate 148 along the inclined surfaces 142 and 144. The cradle 96 is immediately accelerated by the operating springs 92 for rotation in a counterclockwise direction (FIG. 3) resulting in the substantially instantaneous movement of the upper toggle links 102, the toggle spring pin 106 and the lower toggle links 104. As described hereinabove, the impelling surface or kicker 158 acting against the contacting surface 160 of the pin 106 rapidly accelerates the pin 106 in an upward, counterclockwise arc, resulting in a corresponding upward movement of the toggle contact pin 110 and the immediate upward movement of the upper electrical contact 52 to its TRIPPED position (FIG. 15). Since the base portions 284 of all of the upper electrical contacts 52 are biased by the springs 286 into contact with an interior surface 330 formed in each opening 282 of the cross bar 84, the upper electrical contacts 52 move in unison with the cross bar 84, resulting in the simultaneous or synchronous separation of all three of the upper electrical contacts 52 from the lower electrical contacts 50 in the circuit breaker 30. During this trip operation, any electrical arc that may have been present across the contacts 72 and 306 is extinguished.

During this operation, as a result of the change in the lines of action of the operating springs 92, the handle 42 is moved from its CLOSED position (FIG. 3) to its TRIPPED position (FIG. 15). As is apparent, if the handle 52 is obstructed or held in its CLOSED position (FIG. 3), the operating mechanism 58 still will respond to an overload condition or to a short circuit or fault current condition to separate the electrical contacts 50 and 52 as described hereinabove. Furthermore, if the contacts 72 and 306 become welded together, the pin 106 does not move sufficiently to change the line of action of the operating springs 92 (FIG. 3), maintaining the operating springs 92 forward (to the left) of the pivot surfaces 312 of the side plates 86 and biasing the handle 42 to its CLOSED position so as not to mislead operating personnel as to the operative condition of the electrical contacts 50 and 52.

Upon the occurrence of a short circuit or fault current condition, the magnet 178 is immediately energized to magnetically attract the armature 174 into engagement with the magnet 178, resulting in a pivotable or rotational movement of the trip leg 254 of the armature 174 in a clockwise direction (FIG. 3) against the contact leg 194 of the trip bar 172. The resultant rotational movement of the contact leg 194 in a clockwise direction releases the intermediate latch plate 148 causing a trip operation as described hereinabove.

Upon the occurrence of a high level short circuit or fault current condition and as a result of the large magnetic repulsion forces generated by the flow of fault current through the generally parallel contact arms 66 and 308, the electrical contacts 50 and 52 rapidly separate and move to their BLOWN-OPEN positions (depicted in dotted line form in FIG. 3). While the compression spring 70 returns the contact arm 66 of the lower electrical contact 50 to its OPEN position (FIG. 14), the contact arm 308 is held in its BLOWN-OPEN position by the engagement of the surfaces 304 and 298 as described hereinabove. The separation of the electrical contacts 50 and 52 is achieved without the necessity of the operating mechanism 58 sequencing through a trip operation. However, the subsequent sequencing of the operating mechanism 58 through a trip operation forces the upper contact arm 308 against an electrical insulation barrier 332 and the stop 156 in the center pole or phase of the circuit breaker 30 against stops integrally formed in the top cover 32 in the outer poles or phases of the circuit breaker 30 to cause relative rotational movement between the upper electrical contact 52 and the cross bar 84, resulting in the reengagement of the interior surface 330 of the cross bar 84 by the base portion 284 of the upper electrical contact 52 and the resultant separation of the other electrical contacts 50 and 52 in the other poles or phases of the circuit breaker 30.

In accordance with an alternative embodiment (FIGS. 16 through 18) of the circuit breaker 30, an upper electrical contact 410 includes a longitudinal end or base portion 412 having a generally J-shaped slot 414 formed therein. The slot 414 receives a portion of an elongated spring biased locking pin 416 that is disposed against the forward edges of a pair of elongated slots 418 formed through a pair of opposed or spaced apart sidewalls 420 of an enlarged section 270 of the molded cross bar 84. Preferably, an upper, outermost point or edge 422 of the slot 414 engages or contacts the outer periphery of the pin 416 at a distance less than halfway along the diameter of the pin 416 to ensure that upon the occurence of a high level short circuit or fault current of sufficient amperage, an upper, elongated movable contact arm 424 of the electrical contact 410 will be able to freely rotate about the pin 110 to assume a BLOWN-OPEN position (depicted in dotted line form in FIG. 16). Normally, the pin 416 is kept in engagement with the forward portion of surface of the slots 418 by a pair of tension springs 426 fixedly secured to the sidewalls 420 by a pair of spring pins 428. Thus, the pin 416 is at least partially received within the slot 414 to cause the movement of the cross bar 84 in unison with the movement of the upper electrical contact 410.

Figures 16, 17, 19:
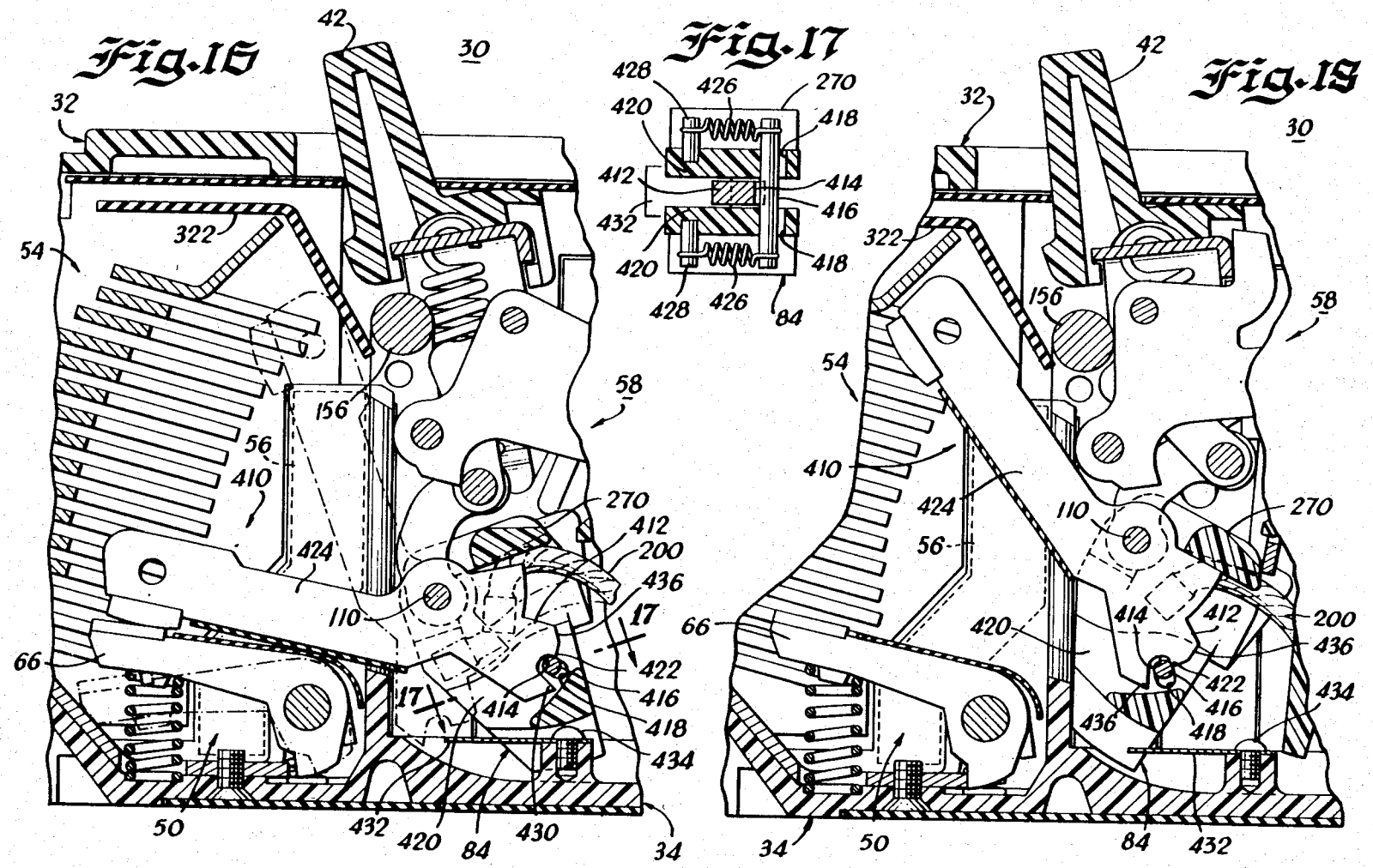
FIG. 16 is an enlarged, fragmentary, cross sectional view of an alternative embodiment of the device of FIG. 1, depicting the device in its CLOSED and BLOWN-OPEN positions.
FIG. 17 is an enlarged, fragmentary, plan sectional view of the device of FIG. 16 taken along line 17—17 of FIG. 16.
FIG. 19 is an enlarged, fragmentary, cross sectional view of an alternative embodiment of the device of FIG. 1, depicting the device in its CLOSED and BLOWN-OPEN positions.

Upon the occurrence of a high level short circuit or fault current of sufficient amperage, the magnetic repulsion forces established by the flow of fault current through the generally parallel contact arms 66 and 424 are sufficient to move the contact edge 422 along the outer periphery of the pin 416, resulting in a rearward displacement of the pin 416 against the force of the tension springs 426. Fault currents of sufficient amperage can disengage the base portion 412 of the upper electrical contact 410 from the pin 416, thereby enabling the substantially unimpeded upward rotation of the upper contact arm 424. A lower contact point or edge 430 is designed to downwardly deflect the free end of an elongated leaf spring 432 secured to the base 34 by a fastener 434. After deflecting the leaf spring 432, the upper electrical contact 410 assumes its BLOWN-OPEN position (FIG. 16). Subsequent contact between the upper electrical contact 410 and the lower electrical contact 50 is prevented by the engagement of the free end of the leaf spring 432 with the base portion 412 in the region of the slot 414.

A subsequent trip operation of the operating mechanism 58 lifts the upper electrical contact 410 from its BLOWN-OPEN position, removing the lock out feature of the leaf spring 432. During such a trip operation, the upper contact arm 424 is forced against the barrier 332 and the stop 156 in the center pole or phase of the circuit breaker 30 or against stops integrally formed in the top cover 32 in the outer poles or phases of the circuit breaker 30 while the cross bar 84 is rotating in a clockwise direction, thus bringing the pin 416 into engagement with an inclined or contoured surface 436 of the base portion 412. By following along the contoured surface 436, the pin 416 is deflected rearwardly in the slot 418 until it passes the contact edge 422 and snaps forward in the slot 414. In this manner, the molded cross bar 84 and the upper electrical contact 410 are reset for subsequent normal movement in unison.

Figures 19, 20, 21:
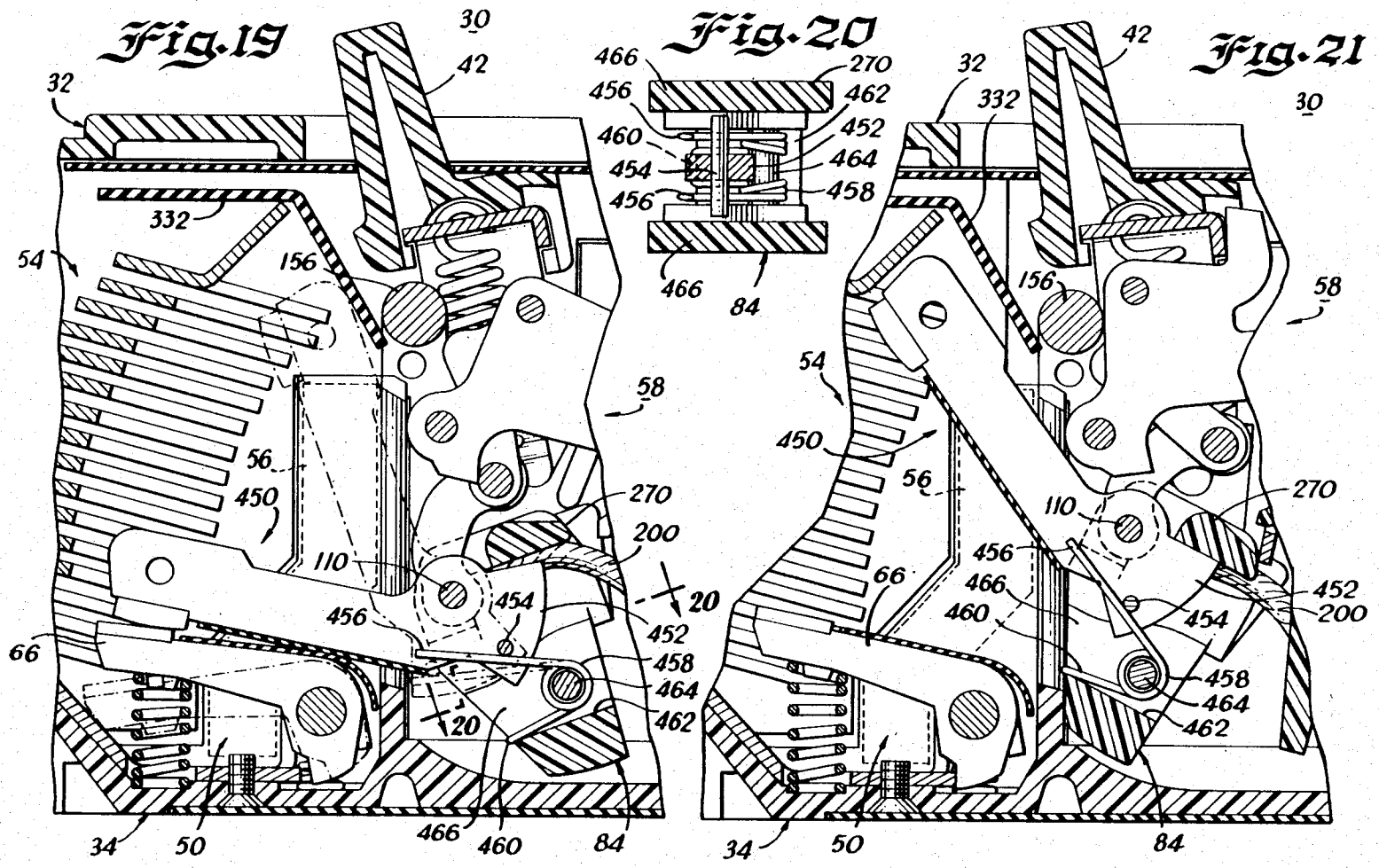
FIG. 20 is an enlarged, fragmentary, plan sectional view of the device of FIG. 19 taken along line 20—20 of FIG. 19.
FIG. 21 is an enlarged, fragmentary, cross sectional view of the device of FIG. 19, depicting the device in its TRIPPED position.

In accordance with a further alternative embodiment (FIGS. 19 through 21) of the circuit breaker 30, an upper electrical contact 450 includes a longitudinal end or base portion 452 with an elongated stop pin 454 fixedly secured thereto and outwardly projecting in opposite directions therefrom. The stop pin 454 is positioned on the base portion 452 to engage and load an upper, elongated free end or spring arm 456 of one or more torsion springs 458. An opposite, elongated lower end or spring arm 460 engages and is loaded by an interior lower surface 462 of the opening 282 formed in the molded cross bar 84. The torsion springs 458 are disposed and retained in position by a spring mounting pin 464 fixedly secured in a pair of opposed or spaced apart sidewalls 466 of the cross bar 84. Thus, during normal operation, the stop pin 454 loads the spring arm 456 with a force at a distance relatively close to the fulcrum of the torsion springs 458. In this manner, the upper electrical contact 450 is caused to move in unison with movements of the cross bar 84. However, in the presence of a high level short circuit or fault current of sufficient amperage, the repulsion forces present as a result of the flow of fault current through the electrical contacts 50 and 450 cause the rapid separation of the electrical contacts 50 and 450 prior to a trip operation of the operating mechanism 58. During such an occurrence, the stop pin 454 upon the clockwise rotation of the upper electrical contact 450 moves forwardly along the spring arm 456, increasing the distance between the location of the stop pin 454 and the fulcrum of the torsion springs 458, thereby decreasing the spring force applied by the spring arm 456 against the stop pin 454. However, the reduced spring force is sufficient to retain the upper electrical contact 450 in its BLOWN-OPEN position (depicted in dotted line form in FIG. 19). During a trip operation by the operating mechanism 58, the upper electrical contact 450 is forced against the barrier 332 and the stop 156 during a clockwise rotational movement of the cross bar 84, causing the consequent rearward movement of the stop pin 454 along the spring arm 456, decreasing the distance between the stop pin 454 and the fulcrum of each torsion spring 458 and reestablishing the normal spring load between the stop pin 454 and the spring arm 456. The upper electrical contact 450 and the cross bar 84 are thus reset for movement in unison.

Figures 22, 23, 24, 25, 26:
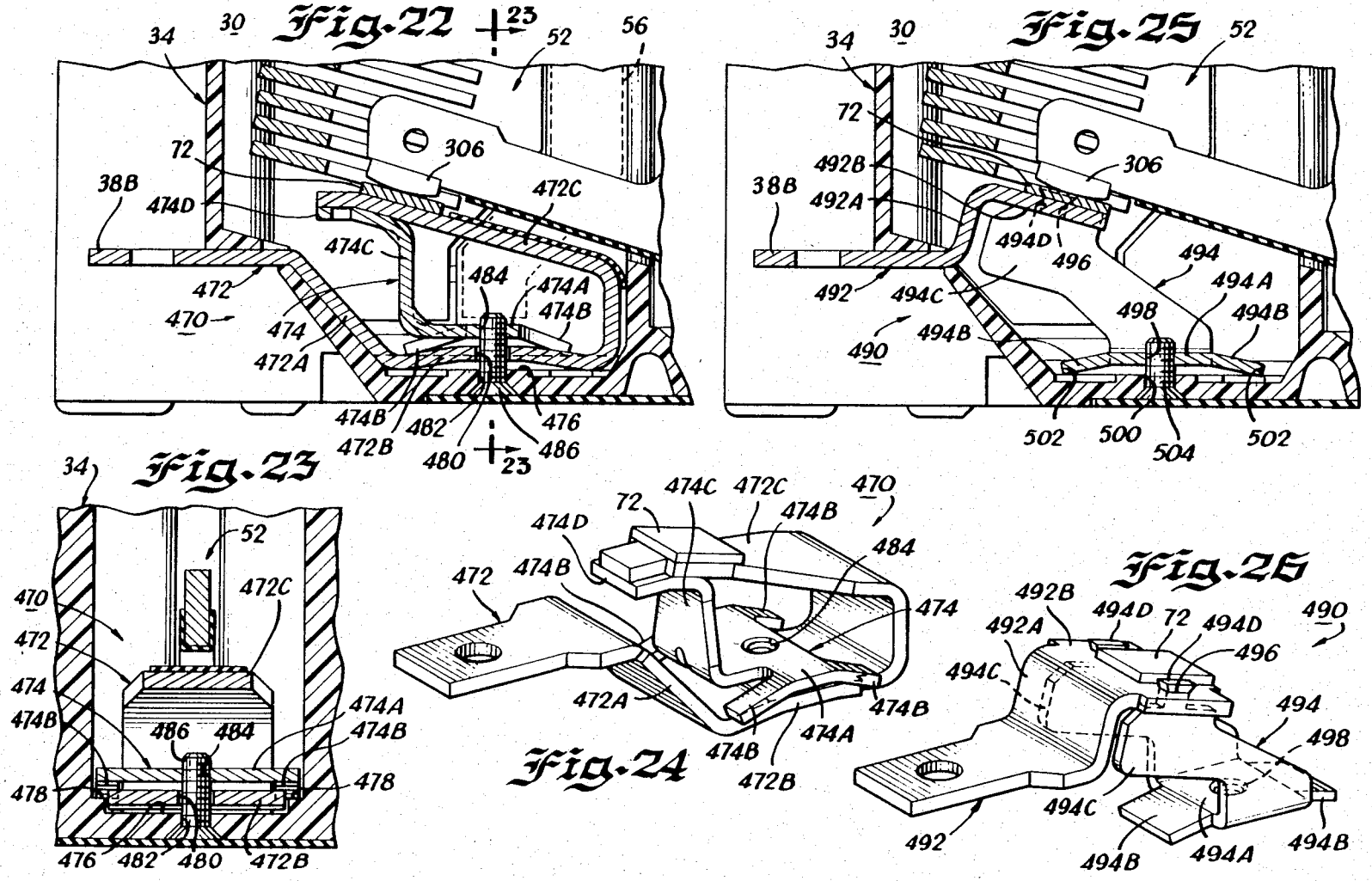
FIG. 22 is an enlarged, fragmentary, cross sectional view of an alternative embodiment of the device of FIG. 1, depicting an alternative adjustable stationary lower electrical contact.
FIG. 23 is an enlarged, fragmentary, cross sectional view of the device of FIG. 22 taken along line 23—23 of FIG. 22.
FIG. 24 is an enlarged, perspective view of the electrical contact of FIG. 22.
FIG. 25 is an enlarged, fragmentary, cross sectional view of an alternative embodiment of the device of FIG. 1, depicting an alternative stationary lower electrical contact.
FIG. 26 is an enlarged, perspective view of the electrical contact of FIG. 25.

In accordance with another alternative embodiment (FIGS. 22 through 24) if the circuit breaker 30, an adjustable, stationary, lower electrical contact 470 includes an integral or one-piece formed copper contact 472 and a separately formed, spacer bracket 474 formed from a material having significantly less conductivity than copper, for example, steel. Extending outwardly from the base 34 is an integrally formed portion of the coper contact 472 that forms the first electrical terminal or the line terminal 38B. The formed copper contact 472 also includes an integral, inclined surface 472A complementarily shaped to an inclined interior surface of the base 34 for engagement therewith. An integrally formed base portion 472B is positioned in a recess 476 (FIG. 23) formed along the interior bottom surface of the base 34 for locating the lower electrical contact 470 in its proper position in the base 34. The formed copper contact 472 also includes an integrally formed, elongated stationary contact arm 472C that supports near its upper end a contact 72 fixedly secured thereto, for example, by brazing.

The spacer bracket 474 includes an integrally formed base portion 474A supported above the base portion 472D by a plurality of integrally formed, deflectable legs 474B. An integrally formed, upstanding spacer leg 474C extends from the base portion 474A to an integrally formed, copper contact support portion 474D. The copper contact support portion 474D is fixedly secured to the underside of the upper end of the contact arm 472C by any suitable means, for example, by a rivet or by brazing.

Preferably, the deflectable legs 474B are positioned on and in contact with a raised shoulder portion 478 that extends upwardly from the interior bottom surface of the base 34. An aperture 480 is formed through the base portion 472B in line with both an aperture 482 formed through the bottom surface of the base 34 and a threaded aperture 484 formed through the base portion 474A. The aligned apertures 480, 482 and 484 receive a mounting screw 486 that secures the lower electrical contact 470 in its position in the base 34 and that adjusts the vertical height in the contact 72 above the base 34. By tightening the mounting screw 486, the legs 474B deflect to reduce the space between the base portions 472B and 474A, thereby lowering the copper contact support portion 474D and the longitudinal end of the stationary contact arm 472C fixedly secured thereto.

Thus, by tightening or loosening the mounting screw 486, the vertical distance between the contact 72 and the base 34 can be precisely adjusted without the use of shims or trial and error procedures commonly resorted to in the prior art. In addition, after determining the desired amount of overtravel of the upper electrical contact 52, the subsequent precise adjustment of the lower electrical contact 470 in each pole or phase of the circuit breaker 30 results in less work being required to place the circuit breaker 30 in its CLOSED position, reducing the required size of and the stress on the operating springs 92 and the force required to move the handle 42 from its OPEN position to its CLOSED position. The adjustable lower electrical contact 470 also permits the contact pressure between the contacts 72 and 406 to be increased for higher current ratings without changing the operating springs 92.

While the lower electrical contact 470 is stationary in operation, blow-apart capability of the electrical contacts 52 and 470 is present due to the configuration of the formed copper contact 472 that provides parallel current paths in the contacts 52 and 470, resulting in high magnetic repulsion forces upon the occurrence of a high level short circuit of fault current condition. Upon such a condition, the electrical contact 52 will rapidly separate from the electrical contact 470 and assume its BLOWN-OPEN position (FIG. 3). The slot motor 56 may be utilized to achieve rapid separation of the contacts 52 and 470.

In accordance with another embodiment (FIGS. 25 and 26) of the circuit breaker 30, a stationary lower electrical contact 490 includes an integral or one-piece formed copper contact 492 supported in the base 34 by a support bracket 494, preferably formed from a material of significantly less electrical conductivity than copper, such as steel. The formed copper contact 472 includes an integrally formed portion extending exteriorly of the interior of the base 34 that forms the first terminal or line terminal 38B. The formed copper contact 492 also includes an upwardly extending inclined surface 492A and a contact mounting or support surface 492B that also functions as an arc runner to transfer an electrical arc formed between the separating upper and lower electrical contacts 52 and 490 to the arc chute 54. A contact 72 is fixedly secured to the support surface 492B by any suitable means, for example, by brazing. The support bracket 494 includes a lower base portion 494A, a pair of positioning or support legs 494B and a pair of integrally formed, upwardly extending support arms 494C that include upwardly projecting tabs 494D extending upwardly from the support arms 494C. The tabs 494D are configured to be received within a pair of complementarily shaped apertures 496 formed through the support surface 492B. When the tabs 494D are inserted through the apertures 496, the tabs 494D are spun over or peened to fixedly secure the formed copper contact 492 in engagement with the support bracket 494. A threaded aperture 498 is formed through the base portion 494A and is aligned with an aperture 500 formed through the bottom surface of the base 34 when the outermost edges of surfaces of the support legs 494B are positioned in engagement with the locating surfaces 502 integrally formed along the bottom surface if the base 34. A threaded mounting screw 504 is received in the aperture 500 and threadedly engages the apertue 498 to securely retain the stationary lower electrical contact 490 in engagement with the base 34.

The stationary lower electrical contact 490 may be used in molded case circuit breakers 30 having lower current ratings than those of the other embodiments of the circuit breaker 30 discussed above and where blow-open capability of the circuit breaker 30 is not required. As is apparent from the configuration of the lower electrical contact 490, a parallel current path between elongated portions of the electrical contacts 52 and 490 does not exist; and, thus, the large magnetic repulsion forces discussed hereinabove with respect to the other embodiments of the circuit breaker 30 are not generated.

Obviously, many modifications and variations of the present invention are possible in light of the above teachings. Thus it is to be understood that, within the scope of the appended claims, the invention may be practiced otherwise than as specifically described hereinabove.

What is claimed and desired to be secured by Letters Patent is:

1. An electrical circuit breaker comprising:

a first electrical contact, a second electrical contact and operating means for moving said first and second electrical contacts into a CLOSED position and into an OPEN position, said operating means comprising a stop and an over-center toggle mechanism, said over-center toggle mechanism comprising at least one upper toggle link and at least one lower toggle link and means for drivingly connecting said upper and lower toggle links to said first electrical contact, said upper toggle link being configured to physically contact said stop during a trip operation of said circuit breaker to increase the speed of separation of said first and second electrical contacts during said trip operation.

2. An electrical circuit breaker comprising:

a first electrical contact, a second electrical contact and operating means for moving said first and second electrical contacts into a CLOSED position and into an OPEN position, said operating means comprising a stop and an over-center toggle mechanism, said over-center mechanism comprising a pair of spaced apart upper toggle links, a pair of spaced apart lower toggle links, and means for drivingly connecting said upper and lower toggle links to said first electrical contact, each of said upper toggle links being configured to physically contact said stop during a trip operation of said circuit breaker to increase the speed of separation of said first and second electrical contacts during said trip operation.

3. An electrical circuit breaker as recited in claim 2 wherein said over-center toggle mechanism further comprises first rigid pin means for interconnecting said pair of upper toggle links and said pair of lower toggle links and second rigid pin means for interconnecting said pair of lower toggle links and said first electrical contact.

4. An electrical circuit breaker as recited in claim 3 wherein said over-center toggle mechanism further includes a movable cradle and third rigid pin means for interconnecting said pair of upper toggle links and said movable cradle, said movable cradle including means for contacting said first rigid pin means during said trip operation to increase the speed of separation of said first and second electrical contacts during said trip operation.

5. An electrical circuit breaker as recited in claim 4 wherein said contacting means comprising an integrally formed portion of said cradle.

6. An electrical circuit breaker as recited in claim 4 wherein said operating means further comprises trip means responsive to an overcurrent condition for actuating said over-center toggle mechanism to separate said first and second electrical contacts during said trip operation.

7. An electrical circuit breaker as recited in claim 6 wherein said trip means includes a pivotable trip mechanisms and an intermediate latch means for latching said trip mechanism and said cradle and for unlatching said trip mechanism and said cradle during a trip operation of said circuit breaker.

8. An electrical circuit breaker as recited in claim 7 wherein said intermediate latch means comprises a generally flat intermediate latch plate having an inclined upper latch surface for latching with said cradle and a lower latch surface for latching with said trip mechanism and pivot means disposed between said upper latch surface and said lower latch surface about which said intermediate latch plate is pivotable.

9. An electrical circuit breaker as recited in claim 8 wherein said operating means includes a pair of spaced apart, rigid side plates for physically supporting at least portions of said over-center toggle mechanism, said pivot means comprising a pair of outwardly projecting pivot arms having generally rectangularly shaped cross sectional configurations, said side plates including apertures formed therein for receiving and mounting said pivot arms, said apertures being configured to limit the pivotal movement of said pivot arms.

10. An electrical circuit breaker as recited in claim 9 wherein said apertures in said side plates are configured as inverted keystones.

11. An electrical circuit breaker as recited in claim 2 further comprising a movable, manually engageable handle for controlling said operating means to move said first and second electrical contacts into a CLOSED position or into an OPEN position, said operating means further comprising handle support means for physically supporting said handle and for interconnecting said handle and said operating means.

12. An electrical circuit breaker as recited in claim 2 further comprising a molded case formed from electrically insulating material within which said first and second electrical contacts and said operating means are disposed.

13. An electrical circuit breaker comprising:

a first electrical contact, a second electrical contact and operating means for moving said first and second electrical contacts into a CLOSED position and into an OPEN position, said operating means comprising a stop and a toggle mechanism including first and second toggle links and pin means for rotatably interconnecting said first and second toggle links, said first toggle link being configured to physically contact said stop during a trip operation of said circuit breaker to increase the speed of separation of said first and second electrical contacts during said trip operation, said toggle mechanism further including a movable cradle, said cradle having means for physically contacting said pin means during said trip operation to increase the speed of separation of said first and second electrical contacts during said trip operation.

14. An electrical circuit breaker as recited in claim 13 wherein said physically contacting means comprises an integrally formed portion of said cradle.

15. An electrical circuit breaker comprising:

separable electrical contacts and operating means for moving said separable electrical contacts into a CLOSED position and into an OPEN position, said operating means including a movable cradle, a trip mechanism and latch means for latching said trip mechanism and said cradle and for unlatching said trip mechanism and said cradle during a trip operation of said circuit breaker, said latch means comprising a generally flat intermediate latch plate physically distinct from and movable relative to both said trip mechanism and said cradle and having an upper latch surface for latching with said cradle and a lower latch surface for latching with said trip mechanism and pivot means disposed between said upper latch surface and said lower latch surface about which said latch plate is pivotable, said pivot means comprising a pair of outwardly projecting pivot arms, said operating means further comprising a pair of spaced apart apertures for receiving and mounting said pivot arms and physically configured relative to said pivot arms for limiting the pivotal movement of said pivot arms.

16. An electrical circuit breaker as recited in claim 15 wherein said apertures are configured as inverted keystones.

* * * * *